US011413516B2

(12) United States Patent
Oberholtzer

(10) Patent No.: US 11,413,516 B2
(45) Date of Patent: Aug. 16, 2022

(54) TRAMPOLINE ROLLER DEVICE

(71) Applicant: Kurt Oberholtzer, Ashland, OH (US)

(72) Inventor: Kurt Oberholtzer, Ashland, OH (US)

( * ) Notice: Subject to any disclaimer, the term of this patent is extended or adjusted under 35 U.S.C. 154(b) by 0 days.

(21) Appl. No.: 17/110,632

(22) Filed: Dec. 3, 2020

(65) Prior Publication Data

US 2021/0220719 A1 Jul. 22, 2021

Related U.S. Application Data

(60) Provisional application No. 62/962,379, filed on Jan. 17, 2020.

(51) Int. Cl.
*A63B 5/11* (2006.01)
*A63B 71/00* (2006.01)

(52) U.S. Cl.
CPC ..... *A63B 71/0036* (2013.01); *A63B 5/11* (2013.01)

(58) Field of Classification Search
CPC ..... A63B 71/0036; A63B 5/11–16
See application file for complete search history.

(56) References Cited

U.S. PATENT DOCUMENTS 2,809,383 A 10/1957 Fenner et al.
2,969,124 A * 1/1961 Nissen ..... A62B 1/22 482/28
3,116,809 A * 1/1964 Nissen ..... A63B 5/11 482/28
3,409,259 A * 11/1968 Cross ..... A63B 3/00 248/214
3,580,570 A * 5/1971 Fenner ..... A63B 71/0036 482/28
5,460,586 A * 10/1995 Wilkinson ..... A63B 22/0012 482/118
5,947,870 A * 9/1999 Hall ..... A63B 5/11 482/27
6,237,169 B1 5/2001 Ying
6,599,221 B1 7/2003 Goldwitz
6,648,799 B2 11/2003 Hall
7,789,803 B2 9/2010 Plante et al.
7,862,479 B2 1/2011 Goldwitz
8,029,413 B2 10/2011 Law et al.
8,226,150 B1 7/2012 Schmeichel et al.
8,534,742 B2 9/2013 Schmeichel et al.
10,010,776 B2 * 7/2018 Gravel ..... A63B 63/004
10,486,048 B2 * 11/2019 Gravel ..... A63B 71/0036
2005/0130804 A1 * 6/2005 Hall ..... A63B 5/11 482/28

(Continued)

OTHER PUBLICATIONS

Aero Industries, Classic Roll Tarp, Internet, Aero Industries, Inc., Mar. 19, 2015, 24 pages, http://www.aeroindustries.com/wp-content/uploads/dlm_uploads/2015/05/0930-104301-Classic-Roll-Tarp-Install.pdf, USA.

(Continued)

*Primary Examiner* — Nyca T Nguyen
(74) *Attorney, Agent, or Firm* — Olav M. Underdal; IDP Patent Services

(57) ABSTRACT

A trampoline roller device which includes attachment assemblies with outer and inner connection elements, which attach to a frame of a trampoline, at least one wheel that can be a roller bar, which is placed between the attachment assemblies on one side of the trampoline, such that lifting from an opposite side enables moving of the trampoline.

17 Claims, 6 Drawing Sheets

(56) References Cited

U.S. PATENT DOCUMENTS

| | | | | |
|---|---|---|---|---|
| 2005/0209053 | A1 | 9/2005 | Knox | |
| 2005/0227812 | A1 | 10/2005 | James | |
| 2006/0105852 | A1* | 5/2006 | Curry | A63B 65/06 473/219 |
| 2007/0004560 | A1* | 1/2007 | Nelson | A63B 5/11 482/29 |
| 2011/0021321 | A1* | 1/2011 | Legg | A63B 5/11 482/29 |
| 2012/0142499 | A1 | 6/2012 | Ikegami et al. | |
| 2017/0209757 | A1* | 7/2017 | Gravel | A63B 63/004 |
| 2017/0239503 | A1* | 8/2017 | Goldwitz | E04H 15/006 |
| 2018/0078840 | A1* | 3/2018 | Gravel | A63B 63/004 |

OTHER PUBLICATIONS

SkyBound, Premium Trampoline Replacement Mat, Internet, Amazon,Jan. 14, 2014, 10 pages, https://www.amazon.com/SkyBound-Premium-Trampoline-Compatible-Trampolines/dp/B00EISJVF0/ref=sr_1_1?dchild=1&keywords=SkyBound+Premium+Trampoline+Replacement&qid=1614193041&sr=8-1, USA.

* cited by examiner

Trampoline Roller System

Trampoline Roller Device

TRAMPOLINE ROLLER DEVICE

CROSS-REFERENCE TO RELATED APPLICATIONS

This application claims the benefit of U.S. Provisional Application No. 62/962,379, filed Jan. 17, 2020; which is hereby incorporated herein by reference in its entirety.

FIELD OF THE INVENTION

The present invention relates generally to the field of bouncing devices, including trampolines, and particularly to devices for moving a trampoline.

BACKGROUND OF THE INVENTION

Bouncing on a trampoline is viewed as a fun and entertaining activity for people of various ages. A typical trampoline assembly includes a bed, a base frame, a plurality of resilient members, e.g., springs, that are attached to and extend between the bed and the base frame to connect the bed to the base frame, a cover that covers at least a portion of the base frame and resilient members, and a plurality of legs that are coupled to the base frame to support the bed and the base frame above a surface. Additionally, in some embodiments, the trampoline assembly further includes an enclosure assembly that inhibits a user from falling off the bed during use.

Typically, the legs are coupled to the base frame via a plurality of connector tubes that are welded to or otherwise secured to the base frame. Additionally, a pin, a bolt and nut combination, or some other connection means can be used to secure the legs to the connector tubes.

Further, the resilient members are attached to the base frame by having an end of the resilient members be positioned within an aperture at or near the top of the base frame. The resilient members create an enormous amount of tension and/or torque, i.e. rotational force, on the base frame. Because the resilient members are attached to the top of the base frame, this tension and/or torque exists even when the trampoline is in a static mode, i.e. when no one is using the trampoline. Moreover, this tension and/or torque is even greater when the trampoline is in a dynamic mode, with someone jumping on the trampoline.

This tension and/or torque can exert great stresses on the connector tubes and the legs of the trampoline. For example, a person bouncing on the bed of the trampoline assembly can cause the resilient members to stretch, thereby imparting an even greater rotational force or torque on the base frame. At the same time as the base frame starts to rotate in a generally inward direction due to the force from the stretching of the resilient members, the legs will start to move in a generally outward direction relative to the base frame. This movement results in the legs becoming unstable, and can cause the connection between the connector tubes and the base frame and/or the connection between the legs and the connector tubes to fail. Thus, the torque exerted on the base frame can result in the wobbling and/or the failure or collapse of one or more of the connector tubes and/or the legs.

Conventionally, the arrangement of the trampoline is such that when a user jumps on an upper surface of the material, the force of the weight of the user on the upper surface causes the springs to expand/elongate and the sheet material flexes, typically in a downwardly direction. The biasing force of the springs to return to their original substantially compressed condition, causes the sheet material to move in an upwardly direction, thereby creating a reactive force in an upwardly direction on the user sufficient to lift the user off the surface of the sheet material and allowing the user to bounce on the upper surface of the material.

Trampolines are widely used by children and a child will typically bounce up and down on it for a period of time. People also use trampolines for exercising on or for doing somersaults and/or the like. However, conventional trampolines are typically of only limited use and provide only limited interest to a user.

Often, a trampoline must be moved or disassembled, such as, for example, to clean the area around the trampoline. However, injuries have resulted from assembling and dissembling the trampoline and its component parts, such as pinched fingers and/or limbs when folding and/or unfolding the trampoline and/or its component parts. An article in the Mar. 3, 1998, New York Times reports that trampoline-related emergency room hospitalizations of children doubled between 1990 and 1995 (to nearly 60,000), and that the rate of injuries shows no sign of abating. Some in the medical community have called for a ban on the sale of home trampolines. While stopping short of a ban, the U.S. Consumer Products Safety Commission has called for safety improvements to home trampolines.

Moreover, trampolines are generally supported by U-shaped supporting devices which pivotably move from a collapsed position to an expanded position. When in the expanded position, the trampoline is difficult to re-position due to the heavy weight of the trampoline net alone. Repositioning of prior art trampolines may lead to injuries as described previously.

Moreover, prior art trampolines generally employ detachable ladders to accommodate mounting and de-mounting onto and off of the trampoline, respectively. Because the detachable ladder is a separate component relative to the trampoline itself, it risks becoming separated from the trampoline which invariably defeats its purpose. For example, if a trampoline must be moved from one location to another location and a user forgets to bring the detachable ladder, then its purpose of facilitating safe mounting and de-mounting is thereby defeated.

Therefore, there is need for a means to move a trampoline in a safe, yet efficient, manner. It is an object of the present invention to provide such means.

As such, considering the foregoing, it may be appreciated that there continues to be a need for novel and improved devices and methods for the transporting of trampolines.

SUMMARY OF THE INVENTION

The foregoing needs are met, to a great extent, by the present invention, wherein in aspects of this invention, enhancements are provided to the existing model of trampoline transportation devices.

In an aspect, a trampoline roller device can include:

a) a roller bar, which can roll when pushed or pulled along a ground surface; and b) at least one attachment assembly, which can attach to at least one end of the roller bar;

wherein the at least one attachment assembly can be configured to rotatably attach to a trampoline frame;

whereby a trampoline can be lifted above the ground surface from an opposite end to the attached trampoline roller device, such that the roller bar can stay on the ground surface when the trampoline is lifted from the opposite end;

such that the trampoline can be pushed or pulled from the opposite end to roll the roller bar along the ground surface, such that the trampoline can be rolled for easy portability.

In a related aspect, the at least one attachment assembly can include:

a) an outer connection element, which can include an outer arcuate portion, such that the outer arcuate portion can be configured to curve about an outer portion of the trampoline frame; and b) an inner connection element, which can include an inner arcuate portion, such that the inner arcuate portion can be configured to curve about an inner portion of the trampoline frame;

wherein the inner connection element can be attachable to the outer connection element, such that the outer and the inner connection element can attach around the trampoline frame.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
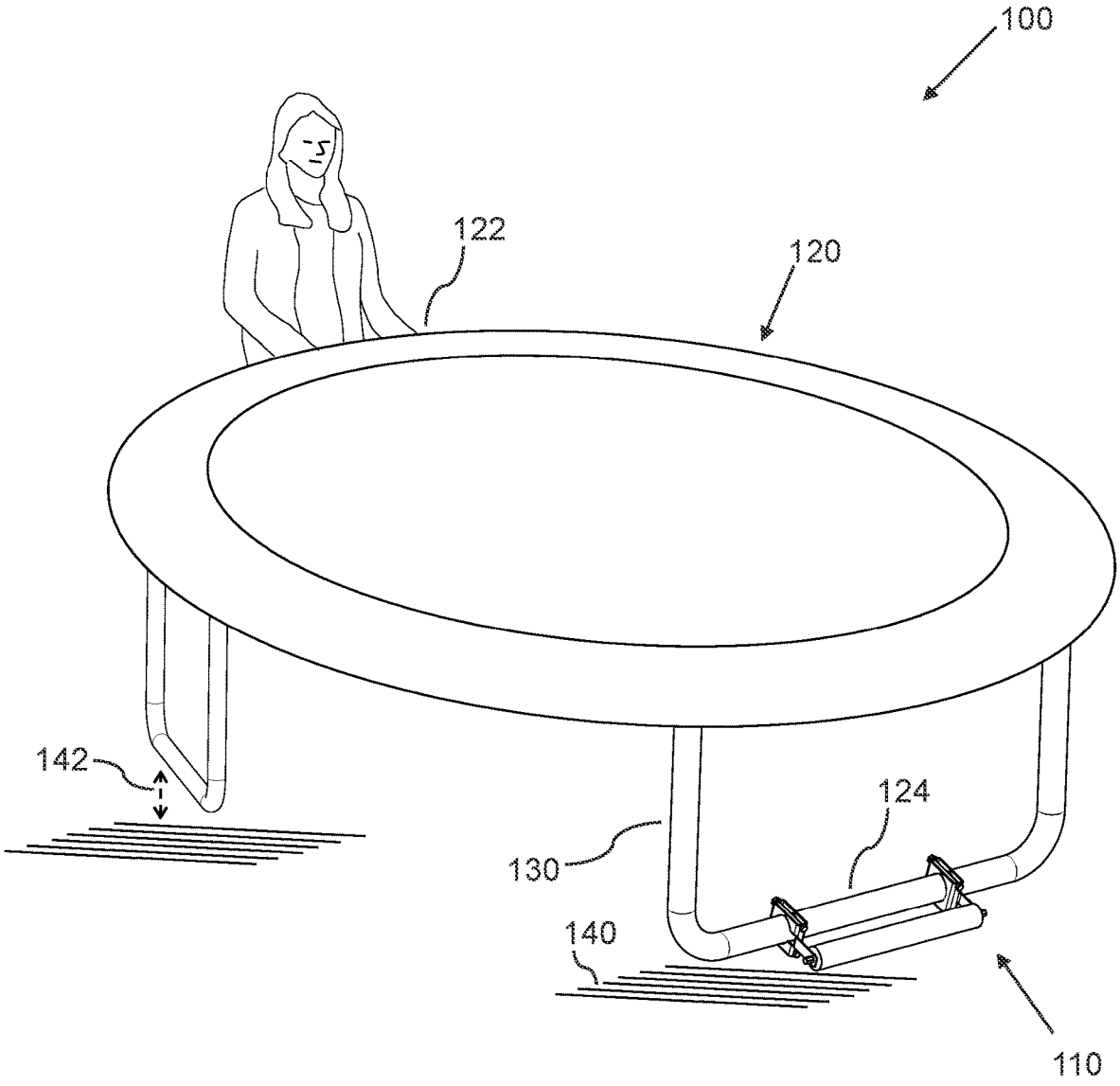
FIG. 1 is an illustration of a trampoline roller system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a trampoline roller device 110 with reference to FIG. 1, in such manner that like reference numerals refer to like components throughout; a convention that we shall employ for the remainder of this specification.

In an embodiment, as shown in FIG. 1, a trampoline roller system 100 can include:

a) a trampoline 120; and b) a trampoline roller device 110 that can be attached to the trampoline 120 in order to easily move the trampoline 120;

such that the trampoline 120 can be lifted and pushed from an opposite side 122 relative to a mounting location of the attached trampoline roller device 110, to allow rolling the trampoline roller device 110 along a ground surface 140, such that the trampoline 120 can be rolled for easy portability.

Figure 2A:
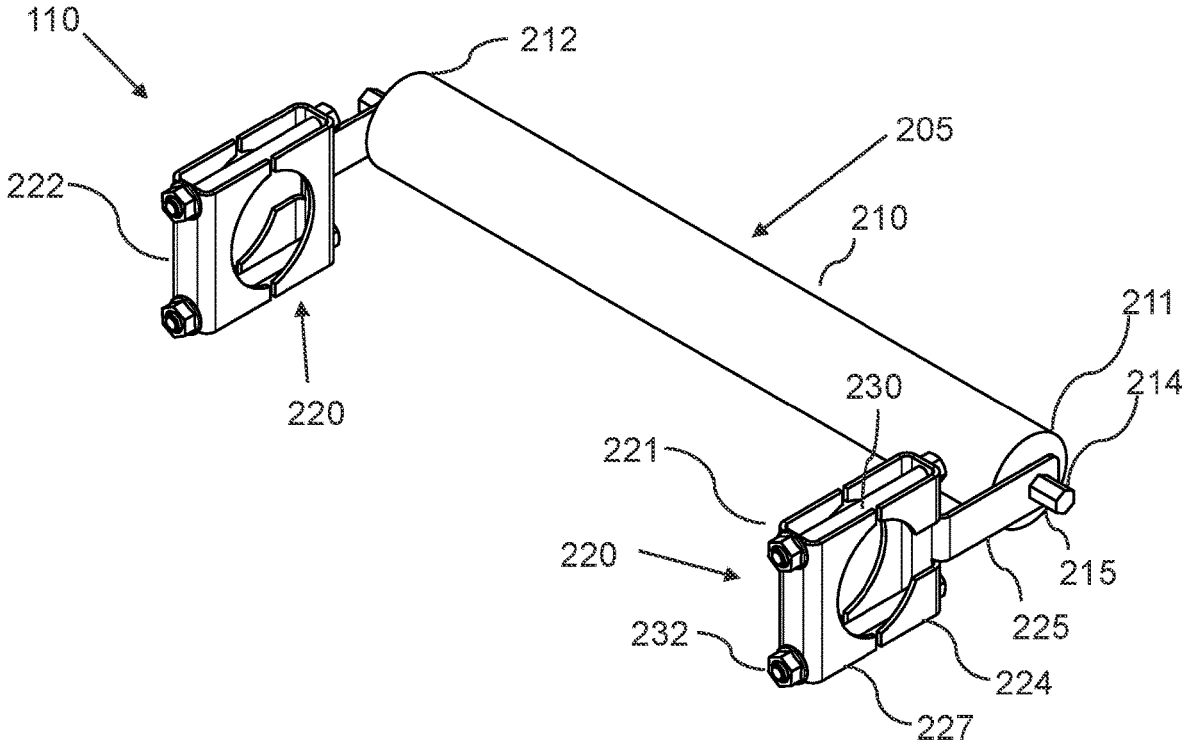
FIG. 2A is a perspective view of a trampoline roller device, according to an embodiment of the invention.
Figure 2B:
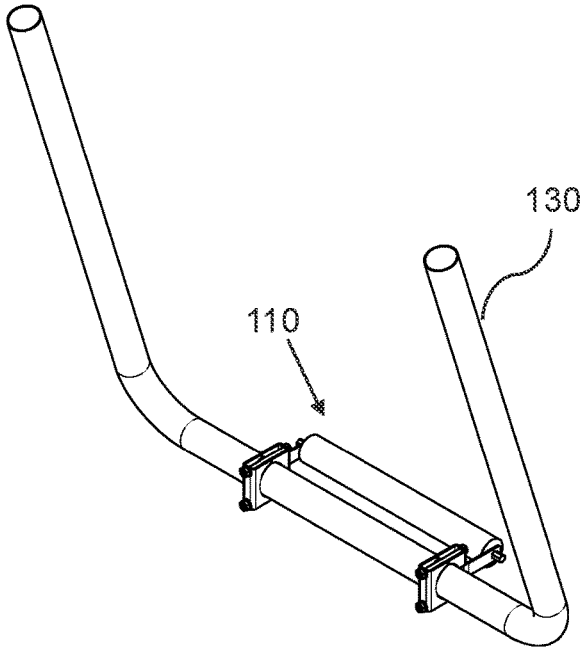
FIG. 2B is a top perspective view of a trampoline roller device attached to a trampoline frame, according to an embodiment of the invention.

In an embodiment, as shown in FIGS. 1, 2A and 2B, a trampoline roller device 110 can include:

a) a roller bar 210, which can roll when pushed along a ground surface 140; and b) at least one attachment assembly 220, which can be connected to at least one end of the roller bar 210, wherein the at least one attachment assembly 220 can include a first/right attachment assembly 221 and a second/left attachment assembly 222, such that the first/right attachment assembly 221 can be configured to connect to a first/right end 211 of the roller bar/wheel 210 and the second/left attachment assembly 222 can be configured to connect to a second/left end 212 of the roller bar/wheel 210;

wherein the at least one attachment assembly 220 can be configured to detachably attach to a frame 130 of a trampoline 120;

such that the roller bar/wheel 210 contacts with a ground surface 140 when the trampoline 120 is lifted from an opposite side 122 relative to a mounting location 124 (on the trampoline frame 130) of the trampoline roller device 110, such that the trampoline 120 can be lifted off 142 (i.e. above 142) the ground surface 140 from an opposite side 122 relative to the attached trampoline roller device 110, as shown in FIG. 1;

whereby the trampoline roller device 110 enables movement (including pushing and pulling) of the trampoline 120 along the ground surface 140, such that the trampoline 120 can be pushed or pulled from the opposite side 122 to roll the roller bar 210 along the ground surface 140, such that the trampoline 120 can be rolled for easy portability.

In a related embodiment, as shown in FIGS. 2A, 3A, 3B, 3C, 4A, 4B and 4C, the at least one attachment assembly 220 can include:

a) an outer connection element 224, which can include an outer arcuate portion 326, such that the outer arcuate portion 326 can be configured to curve along/about an outer portion of the trampoline frame 130, such that the outer arcuate portion 326 matches a curvature of the outer portion of the trampoline frame 130, such that the outer arcuate portion 326 is configured to contact with the outer portion of the trampoline frame 130;

such that the outer arcuate portion 326 can be sized and shaped to engage the roller bar 210; and b) an inner connection element 227, which can include an inner arcuate portion 428, such that the inner arcuate portion 428 can be configured to curve along/about an inner portion of the trampoline frame 130, such that the inner arcuate portion 428 matches a curvature of the inner portion of the trampoline frame 130, such that the inner arcuate portion 428 is configured to contact with the inner portion of the trampoline frame 130;

such that the inner arcuate portion 428 can shaped and sized to engage the trampoline frame 130 and to co-operate with the outer arcuate portion 326 to capture the trampoline frame 130 and attach the roller bar 210 to the trampoline frame 130;

wherein the inner connection element 227 can be attachable to the outer connection element 224, such that the outer and the inner connection element 227 can attach around the trampoline frame 130.

Figure 3A:
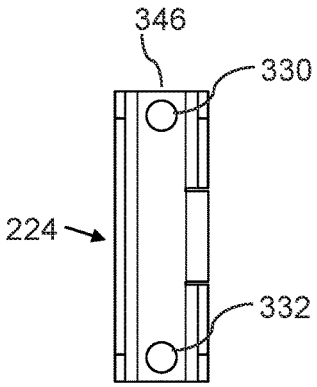
FIG. 3A is a right view of an outer connection element, according to an embodiment of the invention.
Figure 3B:
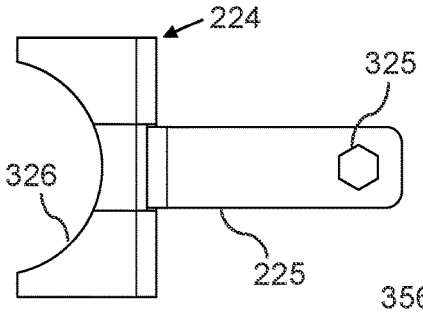
FIG. 3B is a front view of an outer connection element, according to an embodiment of the invention.
Figure 3C:
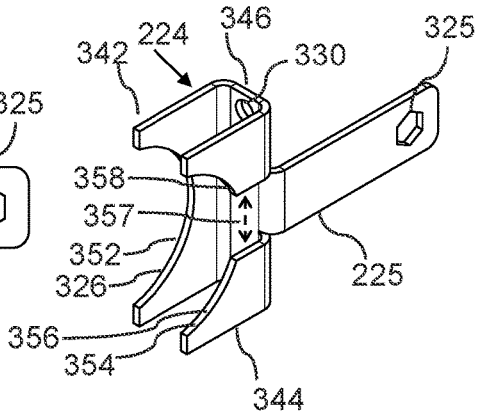
FIG. 3C is a perspective view of an outer connection element, according to an embodiment of the invention.
Figure 4A:
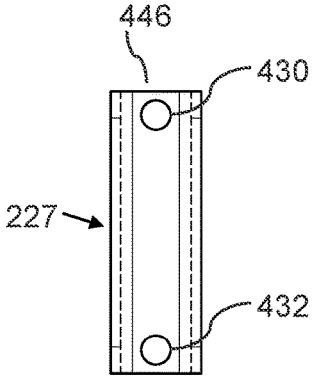
FIG. 4A is a right view of an inner connection element, according to an embodiment of the invention.
Figure 4B:
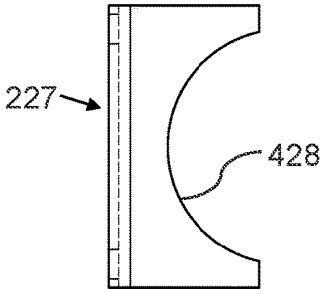
FIG. 4B is a front view of an inner connection element, according to an embodiment of the invention.
Figure 4C:
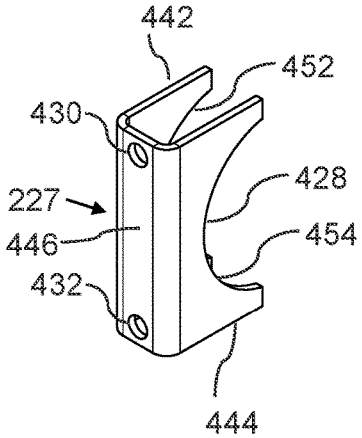
FIG. 4C is a perspective view of an inner connection element, according to an embodiment of the invention.

In a related embodiment, as shown in FIGS. 3C and 4C, the outer connection element 224 can further include:

a) an outer rear piece 346;

b) a first outer flange 342, which includes a first outer arcuate portion 352; and c) a second outer flange 344, which includes a second outer arcuate portion 354;

wherein the first and second outer flanges 342, 344 are connected to the outer rear piece 346, such that the first and second outer flanges 342, 344 are parallel and protrude perpendicularly from the outer rear piece 346;

wherein the first and second outer flanges 342, 344 can be separated by a uniform parallel distance;

such that the outer arcuate portion 326 is comprised of the first and second outer arcuate portions 352, 354.

In a related embodiment, the second outer flange 344 can further include:

a) an upper flange portion 358, which includes a first outer arcuate portion 352; and b) a lower flange portion 356, which includes a second outer arcuate portion 354;

wherein the upper and lower flange portions 358, 356 are separated by a flange gap 357.

In a further related embodiment, the outer connection element 224 can be stamped and folded from one piece of sheet metal, wherein the arm 225 is folded back to create the flange gap 357.

In a related embodiment, as shown in FIGS. 4A, 4B, and 4C, the inner connection element 227 can further include:

a) an inner rear piece 446;

b) a first inner flange 442, which includes a first inner arcuate portion 452; and c) a second inner flange 444, which includes a second inner arcuate portion 454;

wherein the first and second inner flanges 442, 444 each are connected to the inner rear piece 446, such that the first and second inner flanges 442, 444 are parallel and protrude perpendicularly from the inner rear piece 446;

wherein the first and second inner flanges 442, 444 can be separated by a uniform parallel distance;

such that the inner arcuate portion 428 is comprised of the first and second inner arcuate portions 452, 454.

In a further related embodiment, the inner connection element 227 can be stamped and folded from one piece of sheet metal.

In various related embodiments, the outer connection element 224 can include outer arcuate portions 326 of various sizes and the inner connection element 227 can include inner arcuate portions 428 of various sizes to accommodate different trampoline frame 130 elements.

Figure 7:
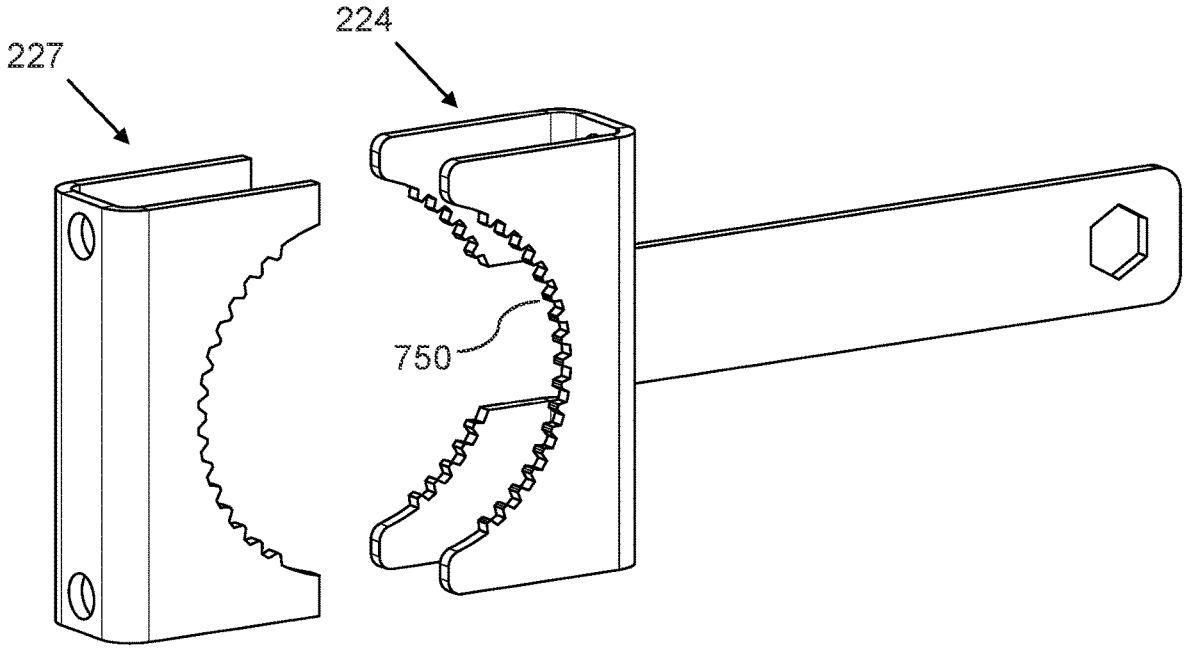
FIG. 7 is a front perspective view of an outer connection element with teeth, according to an embodiment of the invention.

In a further related embodiment, as shown in FIG. 7, at least one of the outer arcuate portion 326 and the inner arcuate portion 428 can further include:

a plurality of teeth 750, which can provide the at least one of the outer arcuate portion 326 and the inner arcuate portion 428 with improved grip, such that the at least one attachment assembly 220 securely attaches to the trampoline frame 130, such that the at least one attachment assembly 220 does not rotate around the trampoline frame 130 when the trampoline 120 is lifted.

Figure 5A:
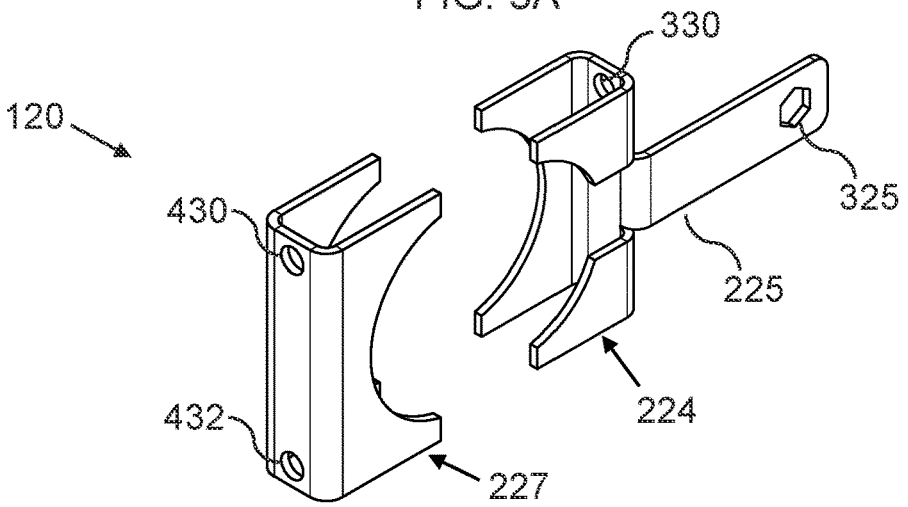
FIG. 5A is a perspective view of an outer connection element and an inner connection element, according to an embodiment of the invention.
Figure 5B:
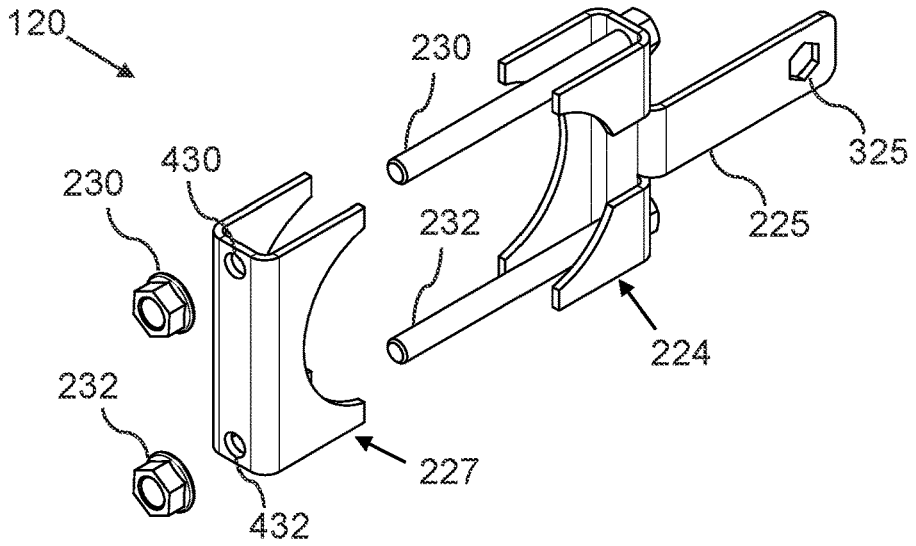
FIG. 5B is a perspective view of an attachment assembly pre-assembly, according to an embodiment of the invention.
Figure 5C:
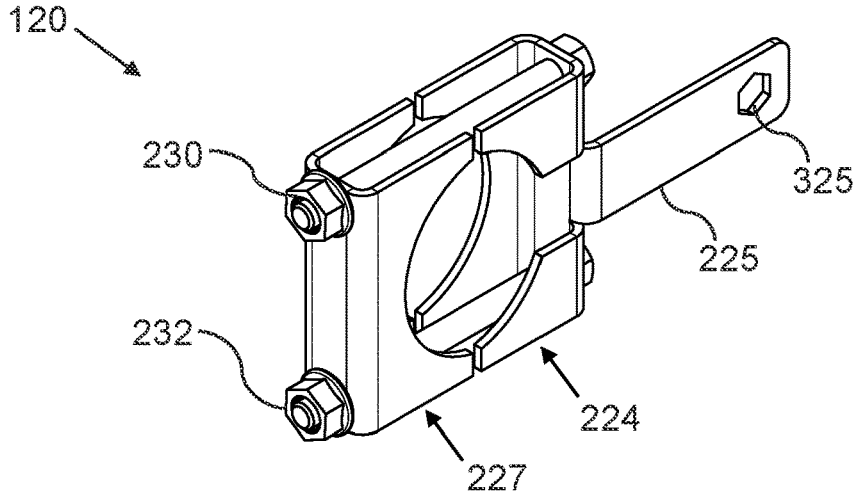
FIG. 5C is a perspective view of an assembled attachment assembly, according to an embodiment of the invention.

In another further related embodiment related embodiment, as shown in FIGS. 2A, 5A, SB and SC, the at least one attachment assembly 220 can further include:

a) an outer upper aperture 330, which can protrude through an upper portion of the outer connection element 224;

b) an inner upper aperture 430, which can protrude through an upper portion of the inner connection element 227;

wherein the outer upper aperture 330 and the inner upper aperture 430 can laterally align;

c) an outer lower aperture 332, which can protrude through a lower portion of the outer connection element 224;

d) an inner lower aperture 432, which can protrude through a lower portion of the inner connection element 227;

wherein the outer lower aperture 332 and the inner lower aperture 432 can laterally align;

e) an upper fastener 230, which can be inserted through the outer upper aperture 330 and the inner upper aperture 430; and f) a lower fastener 232, which can be inserted through the outer lower aperture 332 and the inner lower aperture 432;

such that the upper fastener 230 and the lower fastener 232 can attach the outer connection element 224 and the inner connection element 227;

whereby when the outer connection element 224 and the inner connection element 227 are positioned around the trampoline frame 130, the upper fasteners 230 and the lower fasteners 232 can attach the outer connection element 224 and the inner connection element 227 around the trampoline frame 130.

In a yet further related embodiment, as shown in FIGS. 2A, 3B, 3C and 6B, the at least one attachment assembly 220 can further include:

a) an arm 225, which is connected to the outer connection element 224, such that the arm protrudes outward from the outer connection element 224, such that the arm 225 can be configured to attach to an end of the roller bar 210, such that the outer connection element 224 can attach the roller bar 210 to the at least one attachment assembly 220;

whereby the at least one attachment assembly 220 can attach the roller bar 210 to the trampoline frame 130.

Figure 6A:
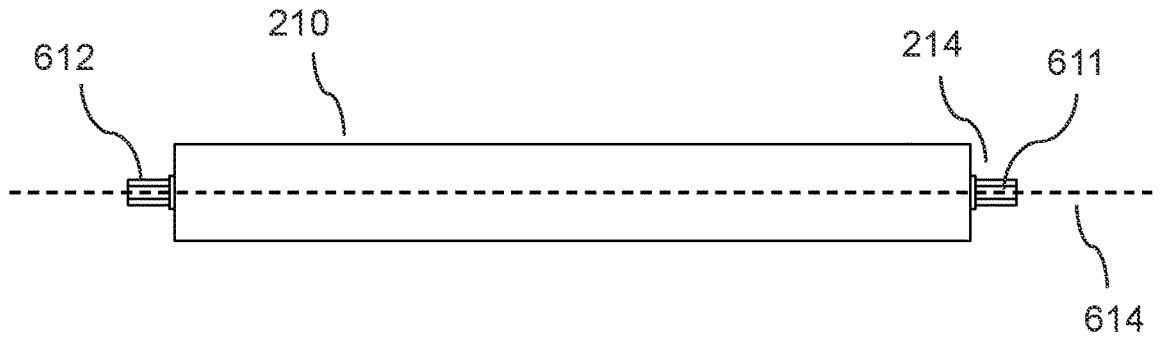
FIG. 6A is top view of a roller bar, according to an embodiment of the invention.
Figure 6B:
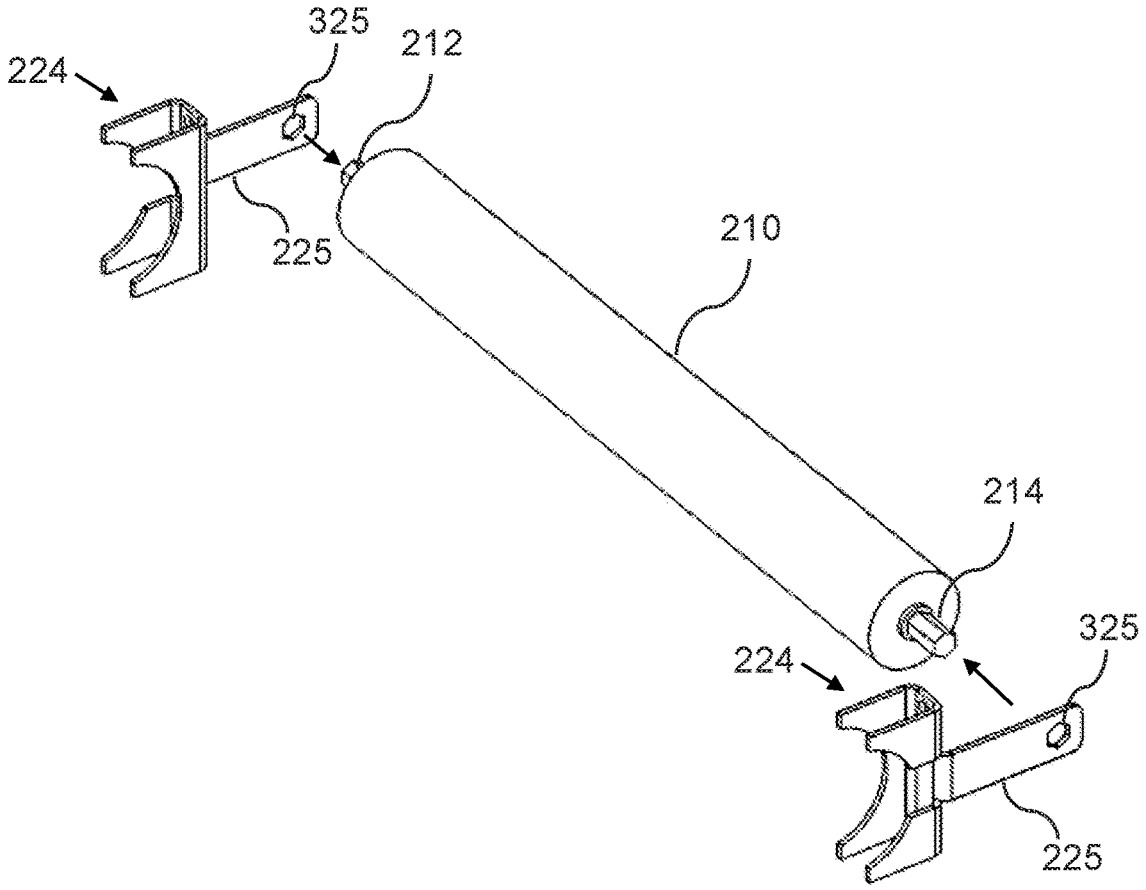
FIG. 6B is perspective view of a roller bar and outer connection elements pre-assembly, according to an embodiment of the invention.

In another related embodiment, as shown in FIGS. 2A, 6A, and 6B, wherein the trampoline roller device 110 can include a roller bar assembly 205 (or wheel assembly 205), which includes:

a) the roller bar 210, which can be configured as an elongated cylinder; and b) at least one axle 214, which is rotatably connected to the roller bar 210, such that the at least one axle 214 can protrude from an end of the roller bar 210 along a central axis 614 of the roller bar, wherein the at least one axle 214 can include a right axle protruding portion 611 and a left axle protruding portion 612 (which can be part of either one axle 214 or two axles 611, 612), such that the right axle protruding portion 611 can protrude from a right end 211 of the roller bar 210 and the left axle protruding portion 612 can protrude from a left end 212 of the roller bar 210;

wherein the at least one axle 214 can be stationary when the roller bar 210 rotates.

In a further related embodiment, the arm 225 can further include:

a) an axle aperture 325, which can be configured to receive the at least one axle 214, such that an outer portion of the at least one axle 214 can be inserted into the axle aperture 325, such that the at least one axle 214 protrudes through the axle aperture 325;

whereby each outer connection element 224 can be attached to at least one end of the roller bar 210, such that the arm 225 can attach the roller bar 210 to the at least one attachment assembly 220.

In a yet further related embodiment, as shown in FIG. 2A, an outer portion 215 of the at least one axle 214 can be configured with a polygonic cross-sectional shape, and the axle aperture can be configured with a matching polygonic shape, as shown in FIGS. 3B and 3C, such that the at least one axle 214 can be rotationally held in position inside the axle aperture.

In a further related embodiment, as shown in FIG. 2A, the polygonic cross-sectional shape of the outer portion 215 of the at least one axle 214 can be a regular hexagon.

Here has thus been described a multitude of embodiments of the trampoline roller device, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A trampoline roller device, comprising:

a) a roller bar; and b) at least one attachment assembly, which is connected to the roller bar, wherein the at least one attachment assembly is configured to attach to a frame of a trampoline, wherein the at least one attachment assembly comprises:

an outer connection element, which comprises an outer arcuate portion, which is configured to contact with an outer portion of the frame of the trampoline; and an inner connection element, which comprises an inner arcuate portion, such that the inner arcuate portion is configured to contact with an inner portion of the frame of the trampoline;

wherein the inner connection element is attachable to the outer connection element, such that the outer connection element and the inner connection element attach around the frame of the trampoline;

such that the roller bar contacts with a ground surface when the trampoline is lifted from an opposite side of the trampoline relative to a mounting location of the trampoline roller device, such that the trampoline is lifted off the ground surface;

whereby the trampoline roller device enables movement of the trampoline along the ground surface.

2. The trampoline roller device of claim 1, wherein the at least one attachment assembly further comprises:

an arm, which is connected to the outer connection element, such that the arm protrudes outward from the outer connection element, such that the arm is configured to attach to the roller bar.

3. The trampoline roller device of claim 2, further comprising a roller bar assembly, which comprises:

a) the roller bar; and b) at least one axle, which is rotatably connected to the roller bar, such that the at least one axle protrudes from at least one end of the roller bar along a central axis of the roller bar;

wherein the at least one axle is configured to be stationary when the roller bar rotates.

4. The trampoline roller device of claim 3, wherein the arm further comprises:

an axle aperture, which is configured to receive the at least one axle, such that an outer portion of the at least one axle is inserted into the axle aperture.

5. The trampoline roller device of claim 4, wherein the outer portion of the at least one axle is configured with a polygonic cross-sectional shape, and wherein the axle aperture is configured with a matching polygonic shape, such that the at least one axle is rotationally held in position inside the axle aperture.

6. The trampoline roller device of claim 5, wherein the polygonic cross-sectional shape of the outer portion of the at least one axle is a regular hexagon.

7. The trampoline roller device of claim 1, wherein the roller bar is configured as an elongated cylinder.

8. The trampoline roller device of claim 1, wherein the at least one attachment assembly comprises:

a) a first attachment assembly; and b) a second attachment assembly;

such that the first attachment assembly is configured to connect to a first end of the roller bar and the second attachment assembly is configured to connect to a second end of the roller bar.

9. The trampoline roller device of claim 1, wherein the outer connection element further comprises:

a) an outer rear piece;

b) a first outer flange, which includes a first outer arcuate portion; and c) a second outer flange, which includes a second outer arcuate portion;

wherein the first and second outer flanges are connected to the outer rear piece, such that the first and second outer flanges are parallel and protrude perpendicularly from the outer rear piece;

such that the outer arcuate portion comprises the first outer arcuate portion and the second outer arcuate portion.

10. The trampoline roller device of claim 1, wherein the inner connection element further comprises:

a) an inner rear piece;

b) a first inner flange, which includes a first inner arcuate portion; and c) a second inner flange, which includes a second inner arcuate portion;

wherein the first and second inner flanges are connected to the inner rear piece, such that the first and second inner flanges are parallel and protrude perpendicularly from the inner rear piece;

such that the inner arcuate portion comprises the first inner arcuate portion and the second inner arcuate portion.

11. The trampoline roller device of claim 1, wherein at least one of the outer arcuate portion and the inner arcuate portion further comprises:

a plurality of teeth, which provide the at least one of the outer arcuate portion and the inner arcuate portion with an improved grip, such that the at least one attachment assembly securely attaches to the frame of the trampoline.

12. The trampoline roller device of claim 1, wherein the at least one attachment assembly comprises:

a) an outer upper aperture, which protrudes through an upper portion of the outer connection element;

b) an inner upper aperture, which protrudes through an upper portion of the inner connection element;

wherein the outer upper aperture and the inner upper aperture laterally align;

c) an outer lower aperture, which protrudes through a lower portion of the outer connection element;

d) an inner lower aperture, which protrudes through a lower portion of the inner connection element;

wherein the outer lower aperture and the inner lower aperture laterally align;

e) an upper fastener, which is inserted through the outer upper aperture and the inner upper aperture; and f) a lower fastener, which is inserted through the outer lower aperture and the inner lower aperture;

such that the upper fastener and the lower fastener attach the outer connection element and the inner connection element;

whereby when the outer connection element and the inner connection element are positioned around the frame of the trampoline, the upper fasteners and the lower fasteners attach the outer connection element and the inner connection element around the frame of the trampoline.

13. A trampoline roller device, comprising:

a) at least one wheel; and b) at least one attachment assembly, which is connected to the at least one wheel, wherein the at least one attachment assembly is configured to attach to a frame of a trampoline, wherein the at least one attachment assembly comprises:

an outer connection element, which comprises an outer arcuate portion, which is configured to contact with an outer portion of the frame of the trampoline;

an inner connection element, which comprises an inner arcuate portion, such that the inner arcuate portion is configured to contact with an inner portion of the frame of the trampoline, wherein the inner connection element is attachable to the outer connection element, such that the outer connection element and the inner connection element attach around the frame of the trampoline;

an outer upper aperture, which protrudes through an upper portion of the outer connection element;

an inner upper aperture, which protrudes through an upper portion of the inner connection element, wherein the outer upper aperture and the inner upper aperture laterally align;

an outer lower aperture, which protrudes through a lower portion of the outer connection element;

an inner lower aperture, which protrudes through a lower portion of the inner connection element, wherein the outer lower aperture and the inner lower aperture laterally align;

an upper fastener, which is inserted through the outer upper aperture and the inner upper aperture; and a lower fastener, which is inserted through the outer lower aperture and the inner lower aperture, such that the upper fastener and the lower fastener attach the outer connection element and the inner connection element;

whereby when the outer connection element and the inner connection element are positioned around the frame of the trampoline, the upper fasteners and the lower fasteners attach the outer connection element and the inner connection element around the frame of the trampoline;

such that the at least one wheel contacts with a ground surface when the trampoline is lifted from an opposite side of the trampoline relative to a mounting location of the trampoline roller device, such that the trampoline is lifted off the ground surface;

whereby the trampoline roller device enables movement of the trampoline along the ground surface.

14. The trampoline roller device of claim 13, wherein the at least one attachment assembly further comprises:

an arm, which is connected to the outer connection element, such that the arm protrudes outward from the outer connection element, such that the arm is configured to attach to the at least one wheel.

15. The trampoline roller device of claim 14, further comprising a wheel assembly, which comprises:

a) the at least one wheel; and b) at least one axle, which is rotatably connected to the at least one wheel, such that the at least one axle protrudes from the at least one wheel along a central axis of the at least one wheel;

wherein the at least one axle is stationary when the at least one wheel rotates.

16. The trampoline roller device of claim 15, wherein the arm further comprises:

an axle aperture, which is configured to receive the at least one axle, such that an outer portion of the at least one axle is inserted into the axle aperture.

17. The trampoline roller device of claim 13, wherein at least one of the outer arcuate portion and the inner arcuate portion further comprises:

a plurality of teeth, which provide the at least one of the outer arcuate portion and the inner arcuate portion with an improved grip, such that the at least one attachment assembly securely attaches to the frame of the trampoline.

* * * * *